US011904429B2

(12) United States Patent
Zuniga et al.

(10) Patent No.: US 11,904,429 B2
(45) Date of Patent: Feb. 20, 2024

(54) SUBSTRATE POLISHING APPARATUS WITH CONTACT EXTENSION OR ADJUSTABLE STOP

(71) Applicant: Applied Materials, Inc., Santa Clara, CA (US)

(72) Inventors: Steven M. Zuniga, Soquel, CA (US); Andrew Nagengast, Sunnyvale, CA (US); Jay Gurusamy, Santa Clara, CA (US)

(73) Assignee: Applied Materials, Inc., Santa Clara, CA (US)

( * ) Notice: Subject to any disclaimer, the term of this patent is extended or adjusted under 35 U.S.C. 154(b) by 43 days.

(21) Appl. No.: 17/495,679

(22) Filed: Oct. 6, 2021

(65) Prior Publication Data

US 2022/0111482 A1 Apr. 14, 2022

Related U.S. Application Data

(60) Provisional application No. 63/091,098, filed on Oct. 13, 2020.

(51) Int. Cl.
*B24B 37/005* (2012.01)
*B24B 37/12* (2012.01)
(Continued)

(52) U.S. Cl.
CPC ..... *B24B 37/005* (2013.01); *B24B 37/02* (2013.01); *B24B 37/12* (2013.01); *B24B 37/20* (2013.01)

(58) Field of Classification Search
CPC ..... B24B 37/005; B24B 37/02; B24B 37/12; B24B 37/20; B24B 37/30; B24B 37/32;
(Continued)

(56) References Cited

U.S. PATENT DOCUMENTS 5,795,215 A 8/1998 Guthrie et al.
5,957,751 A 9/1999 Govzman et al.
(Continued)

FOREIGN PATENT DOCUMENTS

CN 203887679 U 10/2014
CN 106985058 A 7/2017
(Continued)

OTHER PUBLICATIONS

English translation of EP0791431A1 (Year: 1997).*
(Continued)

*Primary Examiner* — Joel D Crandall
*Assistant Examiner* — Sukwoo James Chang
(74) *Attorney, Agent, or Firm* — Patterson + Sheridan, LLP

(57) ABSTRACT

An apparatus for chemical mechanical polishing (CMP) of a substrate is described herein. The apparatus includes an extension disposed between a retaining ring and a chucking membrane. The extension is disposed radially outward from the edge of the substrate and is configured to contact the retaining ring during substrate processing. The extension provides a repeatable and controlled point of contact between the retaining ring and the chucking membrane. The extension may have multiple configurations, such that the contact point between the retaining ring and the chucking membrane is set at a pre-determined location or such that the contact point is moveable by an adjustable stop.

16 Claims, 6 Drawing Sheets

(51) Int. Cl.
*B24B 37/20* (2012.01)
*B24B 37/02* (2012.01)

(58) Field of Classification Search
CPC ..... B24B 37/102; B24B 41/06; B24B 7/228; H01L 21/67092
USPC ..... 451/285, 286, 287, 288, 398
See application file for complete search history.

(56) References Cited

U.S. PATENT DOCUMENTS

| | | | |
|---|---|---|---|
| 6,080,050 | A | 6/2000 | Chen et al. |
| 6,132,298 | A | 10/2000 | Zuniga et al. |
| 6,146,259 | A | 11/2000 | Zuniga et al. |
| 6,159,079 | A | 12/2000 | Zuniga et al. |
| 6,162,116 | A | 12/2000 | Zuniga et al. |
| 6,165,058 | A | 12/2000 | Zuniga et al. |
| 6,241,593 | B1 | 6/2001 | Chen et al. |
| 6,358,121 | B1 | 3/2002 | Zuniga |
| 6,361,419 | B1 | 3/2002 | Zuniga et al. |
| 6,390,904 | B1 | 5/2002 | Gleason et al. |
| 6,572,446 | B1 | 6/2003 | Osterheld et al. |
| 6,602,114 | B1 | 8/2003 | Wang et al. |
| 6,645,044 | B2 | 11/2003 | Zuniga |
| 6,663,466 | B2 | 12/2003 | Chen et al. |
| 6,722,965 | B2 | 4/2004 | Zuniga et al. |
| 6,776,694 | B2 | 8/2004 | Zuniga et al. |
| 6,835,125 | B1 | 12/2004 | Tseng et al. |
| 6,848,980 | B2 | 2/2005 | Chen et al. |
| 6,890,249 | B1 | 5/2005 | Zuniga et al. |
| 7,001,257 | B2 | 2/2006 | Chen et al. |
| 7,001,260 | B2 | 2/2006 | Chen et al. |
| 7,207,871 | B1 | 4/2007 | Zuniga et al. |
| 7,255,771 | B2 | 8/2007 | Chen et al. |
| 7,459,057 | B2 | 12/2008 | Zuniga et al. |
| 7,534,364 | B2 | 5/2009 | Zuniga et al. |
| 9,751,189 | B2 | 9/2017 | Chen et al. |
| 2002/0039879 | A1 | 4/2002 | Zuniga et al. |
| 2003/0029841 | A1 | 2/2003 | Moon et al. |
| 2010/0120335 | A1 * | 5/2010 | Fang ..... B24B 37/32 451/287 |
| 2014/0273776 | A1 * | 9/2014 | Leighton ..... B24B 41/061 451/490 |
| 2015/0174727 | A1 | 6/2015 | Lin et al. |

FOREIGN PATENT DOCUMENTS

| | | | | |
|---|---|---|---|---|
| DE | 102012222012 | A1 * | 6/2014 | ..... H01L 23/49822 |
| EP | 0791431 | A1 * | 8/1997 | ..... B24B 37/30 |
| JP | H0919863 | A | 1/1997 | |
| JP | 2002-530876 | A | 9/2002 | |
| KR | 10-2043479 | | 11/2019 | |
| KR | 20200078828 | A * | 7/2020 | ..... B24B 37/32 |
| SU | 1656344 | A1 * | 6/1991 | ..... G01J 5/00 |
| TW | 323978 | B | 1/1998 | |
| TW | 467803 | B | 12/2001 | |
| TW | 200833465 | A | 8/2008 | |
| WO | 00-13851 | | 3/2000 | |
| WO | 2020176385 | | 9/2020 | |

OTHER PUBLICATIONS

English translation of DE102012222012A1 (Year: 2014).*
English translation of KR20200078828A (Year: 2020).*
English translation of SU1656344A1 (Year: 1991).*
International Search Report and Written Opinion dated Jan. 10, 2022 for Application No. PCT/US2021/053866.
Chinese Office Action dated Feb. 9, 2022 for Application No. 202122469985.0.
Taiwan Office Action dated Sep. 27, 2023 for Application No. 110137686.
Taiwan Search Report dated Sep. 27, 2023 for Application No. 110137686.
Office Action for Japanese Application No. JP 2022-544050 dated Sep. 5, 2023.

* cited by examiner

SUBSTRATE POLISHING APPARATUS WITH CONTACT EXTENSION OR ADJUSTABLE STOP

CROSS-REFERENCE TO RELATED APPLICATIONS

This application claims priority to U.S. Provisional Patent Application No. 63/091,098, filed Oct. 13, 2020, the entirety of which is herein incorporated by reference.

BACKGROUND

Field

Embodiments of the present disclosure generally relate to chemical mechanical polishing (CMP) systems used in the manufacturing of semiconductor devices. In particular, embodiments herein relate to apparatus and method for uniform processing of a substrate near the edges during CMP processing.

Description of the Related Art

Chemical mechanical polishing (CMP) is commonly used in the manufacturing of semiconductor devices to planarize or polish a layer of material deposited on a substrate surface. In a typical CMP process, a substrate is retained in a carrier which presses the backside of the substrate towards a rotating polishing pad in the presence of a polishing fluid. Generally, the polishing fluid comprises an aqueous solution of one or more chemical constituents and nanoscale abrasive particles suspended in the aqueous solution. Material is removed across the material layer surface of the substrate in contact with the polishing pad through a combination of chemical and mechanical activity which is provided by the polishing fluid and the relative motion of the substrate and the polishing pad.

The polishing fluid is generally dispensed onto the polishing pad from a fluid delivery arm towards the center of the polishing pad so that the polishing fluid migrates towards an outer edge of the polishing pad as the polishing pad rotated. The substrate will often shift underneath the carrier slightly and periodically impacts an inside surface of a retaining ring. The force of the substrate against the retaining ring can damage both the edge of the substrate as well as the retaining ring itself. Further, interaction between the substrate and the retaining ring of the carrier causes non-uniformities near the edge of the substrate during CMP processes.

Accordingly, there is a need in the art for articles and related methods that solve the problem described above.

SUMMARY

The present disclosure generally relates to apparatus and methods for improving polishing uniformity near an edge of a substrate. In one embodiment, an apparatus for substrate polishing is described. The apparatus for substrate polishing includes a housing member, a carrier member coupled to the housing member, a support plate coupled to the carrier member, and a substrate chuck member coupled to the support plate. The carrier member forms at least a portion of a carrier volume. The support plate is disposed radially inside of the carrier volume. The substrate chuck member includes a first membrane including a plurality of channel regions and a second membrane coupled to a bottom surface of the first membrane. The second membrane further includes a chucking portion and an extension member, the extension member having a first hardness and the chucking portion having a second hardness less than the first hardness, the extension member extending radially outward of the chucking portion and the first membrane.

In another embodiment, another apparatus for substrate polishing is described. The apparatus includes a substrate support carrier configured to be disposed over a polishing pad. The substrate support carrier includes a housing member, a carrier member coupled to the housing member and forming a portion of a carrier volume inside of the carrier member, a support plate disposed inside of the carrier member and the carrier volume, and a substrate chuck member. The substrate chuck member includes a first membrane including a plurality of channel regions and a second membrane coupled to a bottom surface of the first membrane. The second membrane further includes a chucking portion and an extension member, the extension member having a first hardness and the chucking portion having a second hardness less than the first hardness, the extension member surrounding a part of the chucking portion and extending radially outward of the chucking portion of the second membrane and the first membrane. The extension member includes an outer surface configured to contact an inner surface of a retaining ring when the substrate chuck member moves within the carrier volume. In yet another example, yet another apparatus for substrate polishing is described. The apparatus includes a substrate support carrier. The substrate support carrier includes a housing member, a carrier member coupled to the housing member and forming a portion of a carrier volume therein, a support plate disposed radially inside of the carrier volume and coupled to the carrier member, a substrate chuck member coupled to and disposed below the support plate, and a support plate stop coupled to the carrier member. The support plate stop includes a body, a guide pin disposed into an opening formed in the body and coupled to the carrier member, an extension arm disposed between the body and the support plate, and a bladder disposed on top of the body and between the body and the carrier member.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Embodiments of the present disclosure generally relate to apparatus for reducing the impact of a substrate against the inside surface of a retaining ring during substrate polishing. In particular, embodiments herein relate to a chemical mechanical polish (CMP) system with an extension member disposed radially outward from a substrate chuck member and the outer edge of the substrate.

By providing an extension member disposed outward from the substrate chuck member, the substrate chuck member has a larger diameter than the substrate. The substrate chuck member is coupled to a support plate disposed in a carrier member disposed over a polishing pad within the CMP system. The extension member reduces the amount of movement of the carrier member and prevents the substrate from sliding to impact the inner surface of the retaining ring. The extension member is designed to impact the inner surface of the retaining ring. The extension member may be hard and provides a controlled contact surface between the substrate chuck member and the retaining ring. The control of the contact surface further allows for control of the location of the contact between the extension member and the retaining ring as well as the direction in which the force from impact between the extension member and the retaining ring is directed.

As current location and direction of contact between the edge of the substrate and the retaining ring, in conventional systems, is non-uniform and unpredictable, the force provided by the retaining ring on the substrate is also unpredictable. Unpredictable forces applied to the substrate may cause polishing non-uniformities. The extension member disclosed herein reduces this unpredictability and allows for the location and direction of contact to be controlled to improve polishing uniformity of the substrate and reduce damage to the substrate and the retaining ring.

Other embodiments of the retaining ring include adjustable support plate stops, which are coupled to the carrier member and extend inward towards the substrate chuck member. The support plate stop may have an arm which extends between the support plate stop and the substrate chuck member to impact the edge of the substrate chuck member. The support plate stop provides a similar function as the extension member, but is instead coupled to the carrier member and may be adjusted in the vertical direction by the inflation or deflation of a bladder or an actuator assembly. The adjustable vertical direction of the support plate stop enables the force to be applied to the substrate chuck member at different locations and causes different moments to be applied to the substrate. Adjusting the force applied to the substrate may be beneficial during polishing operations.

Figure 1:
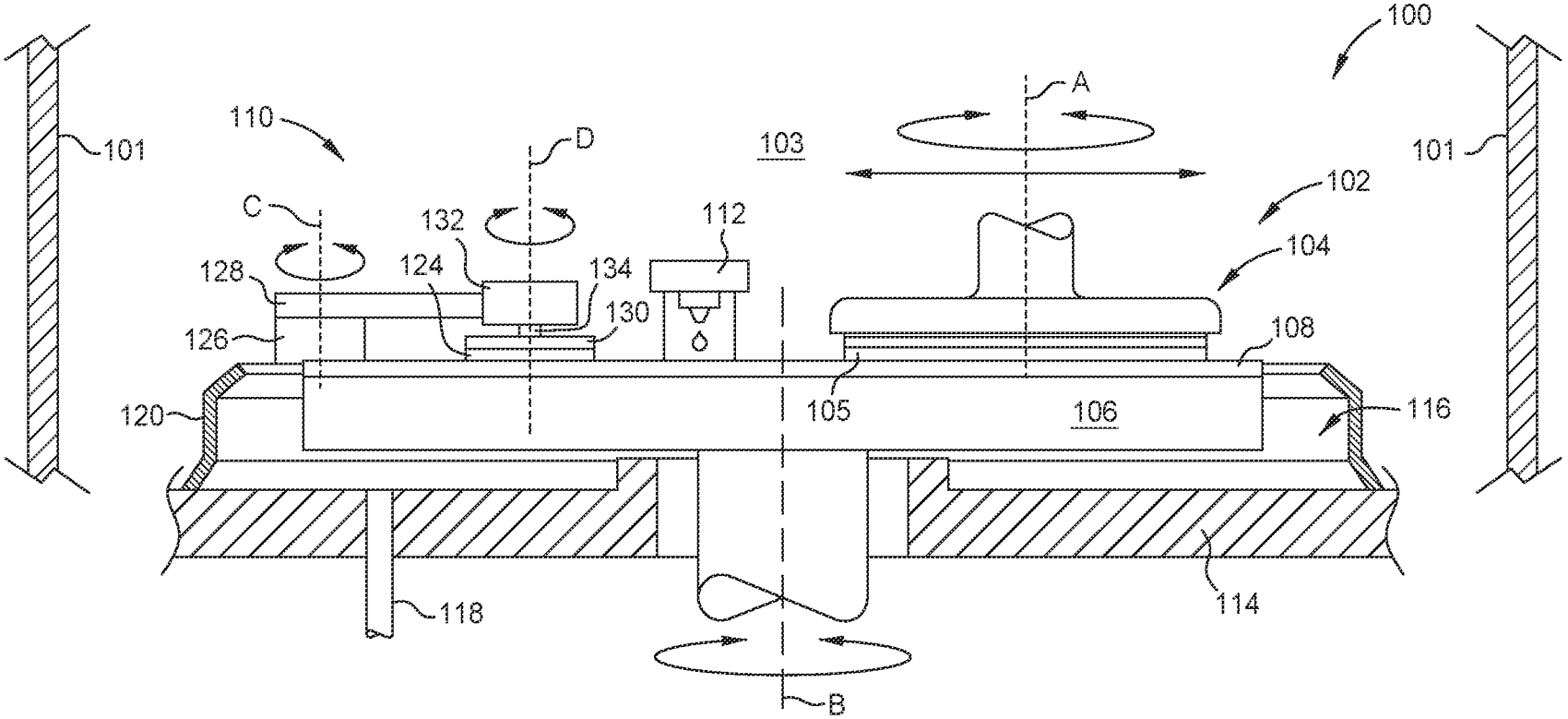
FIG. 1 is a schematic side view of a polishing system for use, according to embodiments disclosed herein.

FIG. 1 is a schematic side view of a polishing system 100 for use according to embodiments disclosed herein. Typically, the polishing system 100 features a frame (not shown) and a plurality of panels 101 which define a substrate processing environment 103. The polishing system 100 includes a plurality of polishing stations 102 (one shown) and a plurality of carrier assemblies 104 (one shown) which are disposed within the substrate processing environment 103.

As shown in FIG. 1, the polishing station 102 includes a platen 106, a polishing pad 108 mounted on the platen 106 and secured thereto, a pad conditioner assembly 110 for cleaning and/or rejuvenating the polishing pad, and a fluid delivery arm 112 for dispensing polishing fluid onto the polishing pad 108. Here, the platen 106 is disposed above a base plate 114 and is circumscribed by a platen shield 120 (both shown in cross section) which collectively define a drainage basin 116. The drainage basin 116 is used to collect fluids spun radially outward from the platen 106 and to drain the fluids through a drain 118 in fluid communication therewith.

The pad conditioner assembly 110 is used to clean and/or rejuvenate the polishing pad 108 by abrading the surface of the polishing pad 108 by urging an abrasive pad conditioner disk 124 (e.g., a diamond impregnated disk) there against. Pad conditioning operations may be done between polishing substrates, i.e., ex-situ conditioning, concurrently with polishing a substrate, i.e., in-situ conditioning, or both.

Here, the pad conditioner assembly 110 includes a first actuator 126 disposed on the base plate 114, a conditioner arm 128 coupled to the first actuator 126, and a conditioner mounting plate 130 having the conditioner disk 124 fixedly coupled thereto. A first end of the conditioner arm 128 is coupled to the first actuator 126, and the mounting plate 130 is coupled to a second end of the conditioner arm 128 that is distal from the first end. The first actuator 126 is used to sweep the conditioner arm 128, and thus the conditioner disk 124, about an axis C so that the conditioner disk 124 oscillates between an inner radius of the polishing pad 108 and an outer radius of the polishing pad 108 while the polishing pad 108 rotates there beneath. In some embodiments, the pad conditioner assembly 110 further includes a second actuator 132 disposed at, and coupled to, the second end of the conditioner arm 128, the second actuator 132 is used to rotate the conditioner disk 124 about an axis D. Typically, the mounting plate 130 is coupled to the second actuator 132 using a shaft 134 disposed there between.

Generally, the rotating carrier assembly 104 is swept back and forth from an inner radius to an outer radius of the platen 106 while the platen 106, and thus the polishing pad 108, rotate about a platen axis B there beneath. The polishing fluid is delivered to the polishing pad 108 using the fluid delivery arm 112 positioned there over and is further delivered to a polishing interface between polishing pad 108 and the substrate 105 by the rotation of the polishing pad 108 about the platen axis B. Often, the fluid delivery arm 112 further includes a delivery extension member and a plurality of nozzles. The plurality of nozzles are used to deliver polishing fluid or relatively high pressure streams of a cleaner fluid, e.g., deionized water, to the polishing pad 108.

The carrier assembly 104 provides a mounting surface for the substrate 105. During substrate processing, the carrier assembly 104 surrounds the substrate 105 and exerts a downward force on the substrate 105 to prevent the substrate 105 from slipping from underneath the carrier assembly 104. The substrate 105, is often vacuum-chucked to the carrier assembly 104. The carrier assembly 104 rotates about the carrier axis A, while urging the substrate 105 against the polishing pad 108. The carrier assembly 104 additionally oscillates in a radial direction over the top surface of the polishing pad.

Figure 2A:
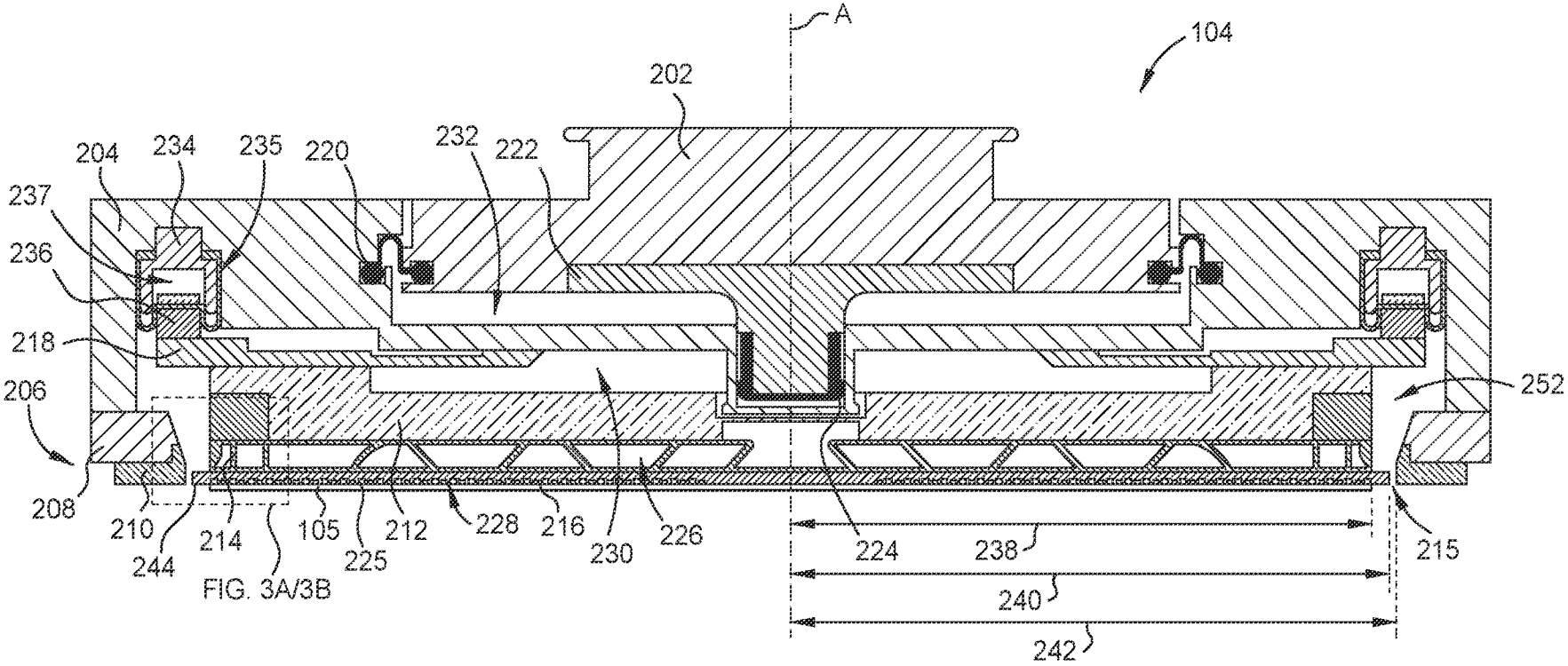
FIG. 2A-2B are schematic side views of a carrier assembly, such as the carrier assembly in FIG. 1.
Figure 2B:
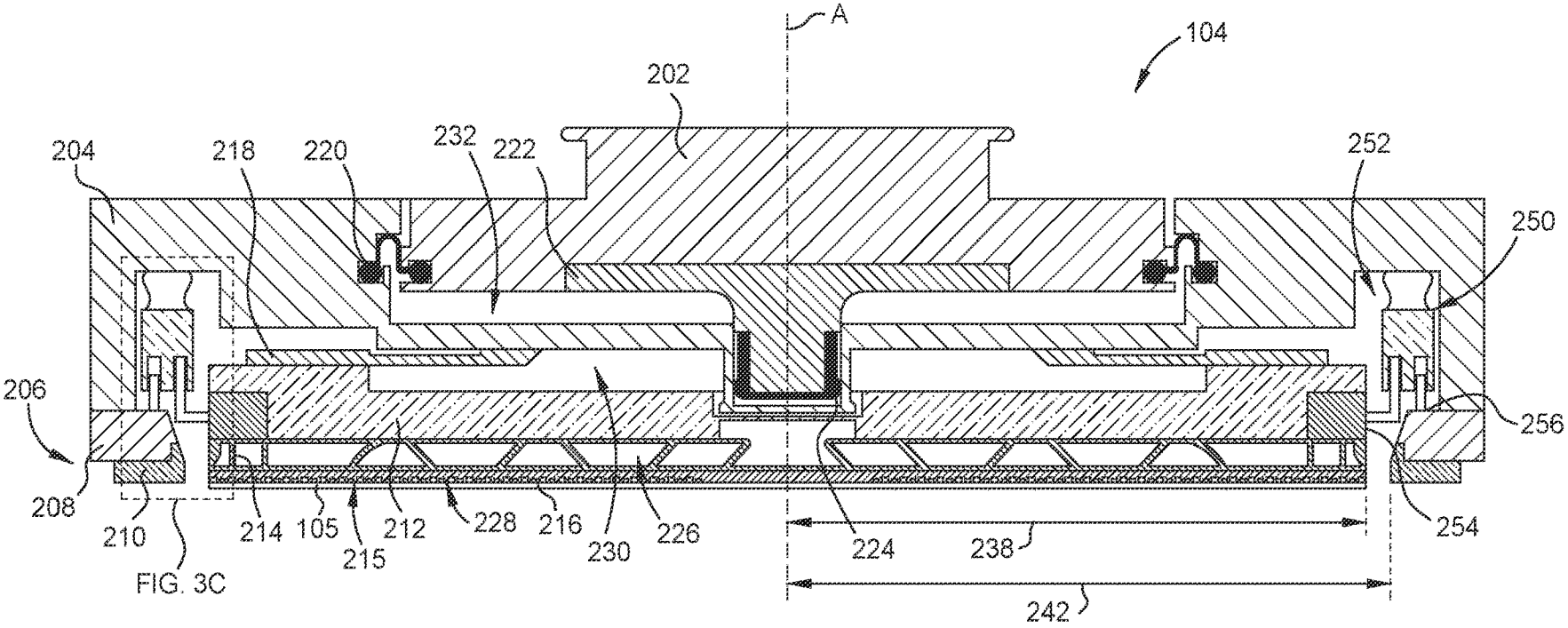

FIG. 2A-2B are schematic side views of the carrier assembly 104. Each of the carrier assemblies 104 features a housing member 202, a carrier member 204, a carrier ring assembly 206 coupled to the carrier member 204, a support plate 212 disposed radially inward of the carrier member 204 and the carrier ring assembly 206, and a substrate chuck element 215 disposed below the support plate 212 to provide a mounting surface for the substrate 105. For the description of FIGS. 2A-2B and 3A-3C, the term radially outward is used with reference to the central axis A of the carrier assembly 104 of FIGS. 1 and 2A unless stated otherwise.

As described above, the carrier assemblies 104 of FIGS. 2A and 2B are used to apply pressure to a substrate, such as the substrate 105. The pressure exerted by components within the carrier assembly 104 push or urge the substrate 105 against the surface of the polishing pad 108. The carrier assemblies 104 are configured to retain the substrate 105 throughout the polishing process. In some instances, the substrate 105 and/or the entire support plate 212 and the substrate chuck element 215 are moveable within a carrier volume 252. The carrier volume 252 is defined as the volume underneath the housing member 202 and a carrier member 204 of the carrier assembly 104 and above the surface of the polishing pad 108 (FIG. 1). The majority of the carrier volume 252 is occupied by the support plate 212 and the substrate chuck element 215.

The housing member 202 is a support member and an uppermost portion of the carrier assembly 104. The housing member 202 includes a centering piece 222, which is disposed on the bottom surface of the housing member 202 and is centered about the central axis A. The centering piece 222 further includes a cover 224. The cover 224 is disposed about a portion of an extension of the centering piece 222, which extends downwards. The cover 224 is configured to reduce the friction force between the centering piece and a depression within the carrier member 204.

The carrier member 204 is disposed around and flexibly coupled to the housing member 202 by use of a second flexible support 220. The carrier member 204 is disposed around each of the support plate 212 and the substrate chucking element 215. The carrier member 204 covers each of the support plate 212 and the substrate chucking element 215 and is disposed between the support plate 212 and the housing member 202. The carrier member 204 includes an outer ring which extends downward and around the outer diameters of the support plate 212 and the substrate chucking element 215.

The carrier ring assembly 206 is attached to an outer portion of the carrier member 204. The carrier ring assembly 206 is coupled to the bottom of the outer ring of the carrier member 204. The carrier ring assembly 206 includes a lower annular portion and an upper annular portion, such as a substrate retaining ring 210 and a backing ring 208 respectively. The substrate retaining ring 210 is typically formed of a polymer which is bonded to the backing ring 208 using a bonding layer (not shown) disposed therein. The backing ring 208 is formed of a rigid material, such as a metal or ceramic, and is secured to the carrier member 204 using a plurality of fasteners (not shown). Examples of suitable materials used to form the substrate retaining ring 210 and the backing ring 208 respectively include any one or combination of the polishing fluid chemical resistant polymers, metals, and/or ceramics described herein. During substrate processing, the substrate retaining ring 210 surrounds the substrate 105 to prevent the substrate 105 from slipping out from underneath the carrier assembly 104.

Typically, a first volume 230 and a plurality of channels 226 formed in first membrane 214 are each individually pressurized during polishing to cause the support plate 212, the membrane 214, and the substrate chuck element 215 to exert a downward force on the substrate 105 while the carrier assembly 104 rotates about the carrier axis A, thus urging the substrate 105 against the polishing pad 108 (FIG. 1). Before and after polishing, a vacuum is applied to the first volume 230 so that the substrate chuck element 215 is deflected upwards to create a low pressure pocket between the substrate chuck element 215 and the substrate 105, thus lifting the support plate 212 and a chucked substrate 105 from the surface of the polishing pad. The substrate may be "chucked" to the membrane 214 by applying a vacuum pressure to one or more of the plurality of channels 226 formed in first membrane 214.

The inner diameter of the substrate retaining ring 210 is greater than the diameter of the substrate 105 to allow for some clearance therebetween during the polishing process and substrate loading and unloading operations. The inner diameter of the substrate retaining ring 210 may be greater than the diameter of the substrate 105 by about 2 mm or more, or about 3 mm or more. Similarly, the outer diameter of the substrate mounting surface of the substrate chuck element 215 is less than the inner diameter of the substrate retaining ring 210 to allow the substrate chuck element 215 to move relative thereto. The clearance between the substrate 105 and the substrate retaining ring 210 and between the substrate chuck element 215 and the substrate retaining ring 210 creates a gap. The dimensions and gap distances between the substrate chuck element 215 and the substrate retaining ring 210 are described in greater detail below.

The substrate chuck element 215 is coupled to the bottom of the support plate 212. In some embodiments, the substrate chuck element 215 includes multiple layers and is configured to grip the surface of the substrate 105 by applying a vacuum to one or more of the plurality of channels 226 formed in first membrane 214. The substrate chuck element 215 extends across substantially the entire bottom surface of the support plate 212.

The substrate chuck element 215 includes a first membrane 214 and a second membrane element 216. The first membrane 214 includes a plurality of channels 226 formed therethrough. One or more of the channels 226 are annular and are centered about the axis A. In the embodiments of FIGS. 2A and 2B, one central channel is disposed through the axis A and eight annular channels are disposed around the central channel and the axis A to equal a total of nine channels 226 formed within the first membrane 214 of the substrate chuck element 215. In some embodiments, about 5 channels 226 to about 15 channels 226, such as about 6 channels 226 to about 12 channels 226, such as about 7 channels 226 to about 10 channels 226 may be included. Each of the channels 226 are in fluid communication with gas passages formed through the support plate 212 (not shown). The channels 226 distribute gases and apply positive and negative gas pressures equally about the axis A. The first membrane 214 of the substrate chuck element 215 is a soft and/or flexible material, such as an elastomeric material (e.g., silicone material) and allows deflection of the first membrane 214 as the pressure within each of the channels 226 is increased or reduced.

The second membrane element 216 is disposed on the bottom surface of the first membrane 214. In some embodiments, the second membrane element 216 includes a relatively stiff material, as compared to the first membrane material 214. The second membrane element 216 may be a plastic material. In some embodiments (such as the embodiments of FIGS. 3A-3B), the second membrane element 216 includes multiple layers which include both pliable and semi-rigid or rigid materials. The second membrane element 216 includes a chucking surface 228 and a plurality of grooves 225 disposed through the chucking surface 228. The chucking surface 228 and the grooves 225 are pliable, so that when a substrate, such as the substrate 105 comes into contact with the chucking surface 228, the chucking surface 228 deforms without damaging the substrate 105. Pressure changes within the one or more channels 226 changes the pressure within the grooves 225 and creates a chucking or de-chucking action between the substrate 105 and the second membrane element 216. The chucking force at different locations of the surface of the substrate 105 is controlled by controlling the pressure applied to the backside of the substrate 105 through the channels 226 and the grooves 225. The pressure within each of the channels 226 may be altered throughout a substrate polishing process to improve the uniformity of the polishing process. In some embodiments, the grooves 225 are in fluid communication with one or more gas channels (not shown) that are coupled to a gas source and/or vacuum source or even to of the channels 226 to create pressure within the grooves 225. Each of the channels 226 may have a different or the same gas pressures to enable different levels of vacuum force across the radius of the substrate 105.

The support plate 212 and the substrate chuck element 215 are attached to the carrier member 204 using a first flexible support 218 as described herein. The first flexible support 218 is an annular flexure and allows the substrate 105, the support plate 212, and the substrate chuck element 215 to move relative to the carrier member 204 during substrate processing in both a vertical and a horizontal direction (wherein the vertical direction is parallel to the axis A and the horizontal direction is parallel to the top surface of the polishing pad 108 (FIG. 1). The support plate 212, the carrier member 204, and the first flexible support 218 collectively define the first volume 230 between the support plate 212 and the carrier member 204. The first flexible support 218 may bend to allow vertical movement of the support plate 212 with respect to the carrier member 204. The first flexible support 218 simultaneously supports the load of the support plate 212 while allowing for controlled movement of the support plate 212.

A second flexible support 220 is disposed between the carrier member 204 and the housing member 202. The second flexible support 220 is an annular support coupling the carrier member 204 to the housing member 202. A second volume 232 is defined between the carrier member 204 and the housing member 202. The second flexible support 220 forms a seal between the carrier member 204 and the housing member 202 in order to allow the second volume 232 to be pumped to either a higher or a lower pressure than the surrounding environment. The pressure within the second volume 232 influences the vertical deflection of the carrier member 204 with respect to the housing member 202.

The embodiment of FIG. 2A includes an extension member 244 of the second membrane element 216. Embodiments of the extension member 244 of the second membrane element 216 are described in greater detail in FIGS. 3A and 3B. The extension member 244 extends outwards from a central region of the second membrane element 216 and towards the substrate retaining ring 210. The extension member 244 has a diameter greater than the diameter of the substrate 105 and the diameter of the first membrane 214 when it is unpressurized. The extension member 244 prevents the substrate 105 from contacting the substrate retaining ring 210 by extending outward from the edges of the substrate 105.

In some embodiments, the radius of the substrate 105 is defined as a first radius 238. The first radius 238 may be about 140 mm to about 155 mm, such as about 145 mm to about 152 mm, such as about 150 mm. In one example, for 300 mm wafer semiconductor polishing processes the first radius 238 will vary from 150 mm±0.1 mm. The outer radius of the extension member 244 of the second membrane element 216 is defined as a second radius 240. The second radius 240 may be about 151 mm to about 155 mm, such as about 151 mm to about 153 mm, such as about 152 mm to about 153 mm. The second radius 240 may be about 0.5% to about 2% larger than the first radius 238, such about 0.75% to about 1.5% larger. The inner radius of the substrate retaining ring 210 is defined as a third radius 242. The third radius 242 may be about 153 mm to about 156 mm, such as about 153 mm to about 155 mm, such as about 154 mm to about 155 mm. The third radius 242 may be about 3% to about 5% larger than the first radius 238, such as about 3% to about 4% larger than the first radius 238, such as about 3.5% to about 4% larger than the first radius 238. The third radius 242 may be about 0.5% to about 5% larger than the second radius 240, such as about 0.75% to about 3%, such as about 0.75% to about 2%, such as about 1% to about 2%. The third radius 242 may be about 1 mm to about 10 mm greater than the second radius 240, such as about 1 mm to about 5 mm, such as about 1 mm to about 3 mm.

A bladder 235 is disposed between the carrier member 204 and the first flexible support 218. The bladder 235 is coupled to the carrier member 204 by a first bladder member 234 and to the first flexible support 218 by a second bladder member 236. The first bladder member 234 and the second bladder member 236 are annular and are coupled together to form the bladder 235. Each of the first bladder member 234 and the second bladder member 236 may be roughly U-shaped or Y-shaped. The first bladder member 234 is disposed so that the open end of the U-shape or the Y-shape is facing upwards. The second bladder member 236 is disposed so that the open end of the U-shape or the Y-shape is facing downwards. The arms of the open ends of both the first and second bladder members 234, 236 are interconnected and form a sealed cavity 237. The sealed cavity 237 may be inflated or deflated to push and pull the first flexible support 218 relative to the carrier member 204.

The embodiment of FIG. 2B is similar to the embodiment of FIG. 2A, but does not include a bladder 235 or the extension member 244 extending from the second membrane element 216 and radially outward of the edge of the substrate 105. The embodiment of FIG. 2B instead includes a support plate stop 250 disposed within the carrier volume 252. The support plate stop 250 may alternatively be used in combination with the extension member 244 (FIG. 2A), but in this embodiment, the bladder 235 would not be present.

The outer edge of the second membrane element 216 of FIG. 2B does not include the extension member 244 and thus is in line with the outer edge of the first membrane 214 and the outer edge of the substrate 105. The second membrane element 216 is otherwise similar to that described in FIG. 2A.

Figure 3A:
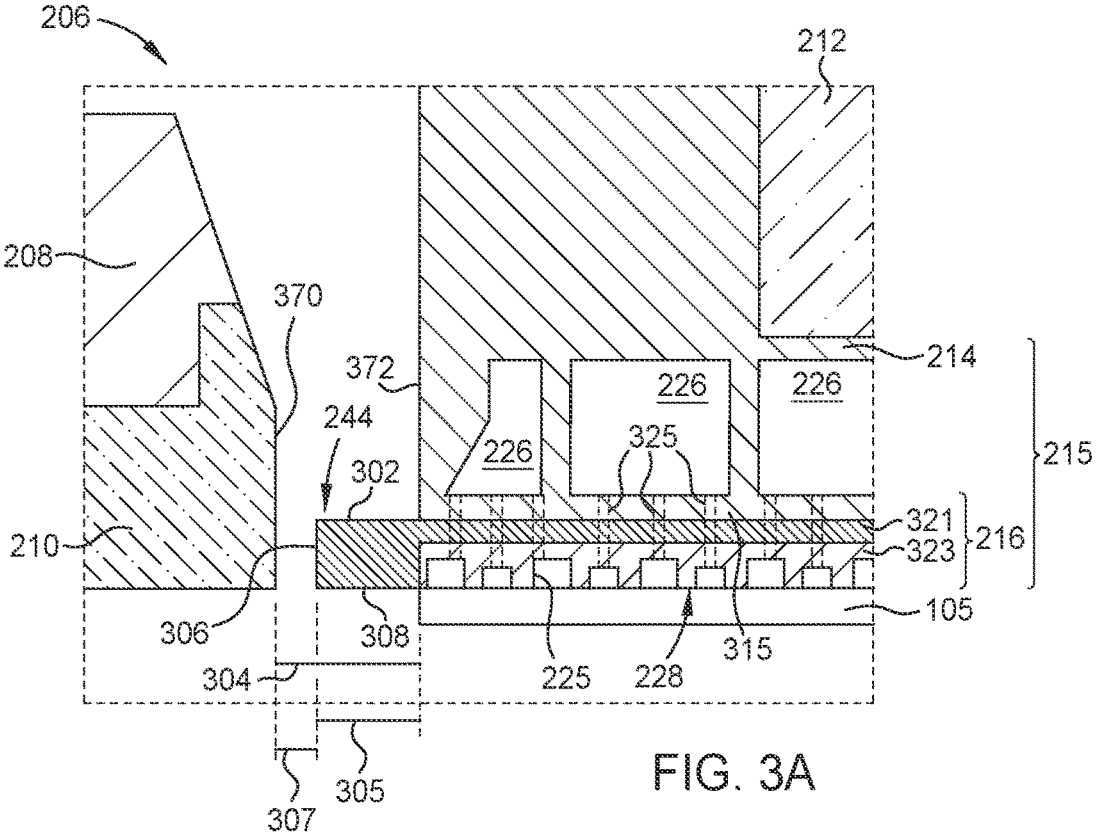
FIG. 3A is a schematic sectional view of an extension member provided herein, according to an embodiment.
Figure 3B:
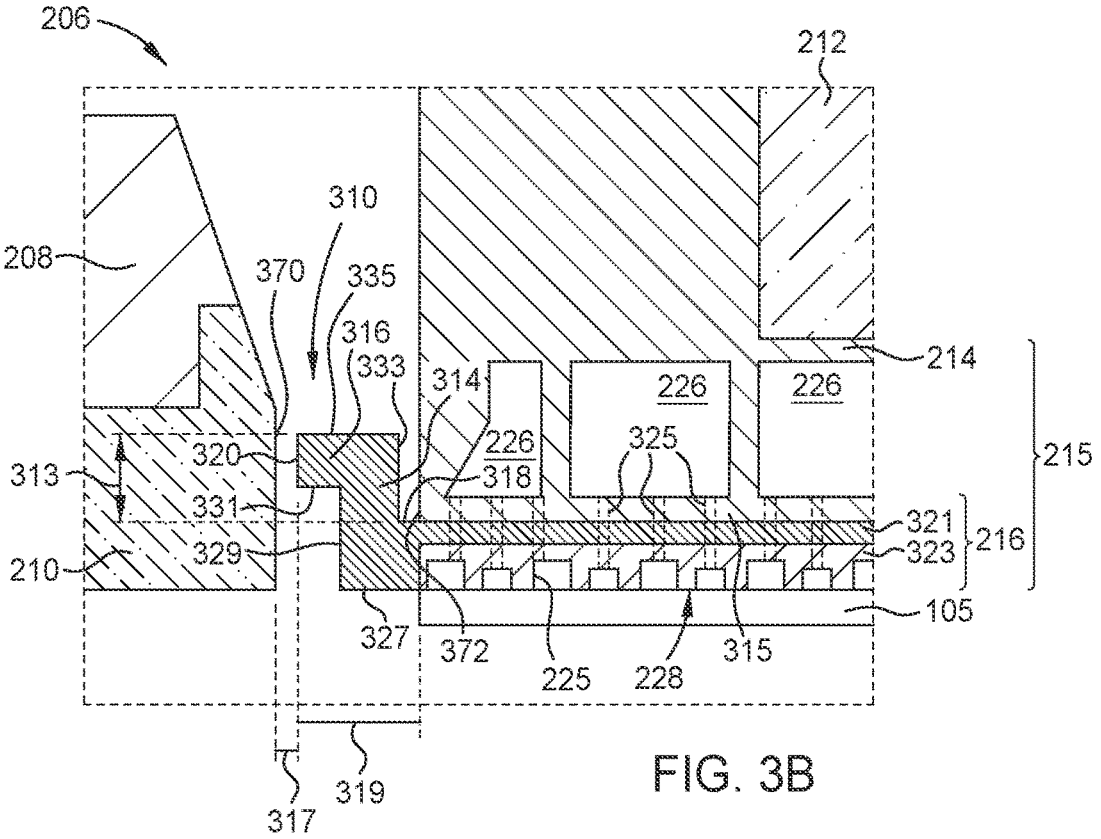
FIG. 3B is a schematic sectional view of an extension member provided herein, according to another embodiment.
Figure 3C:
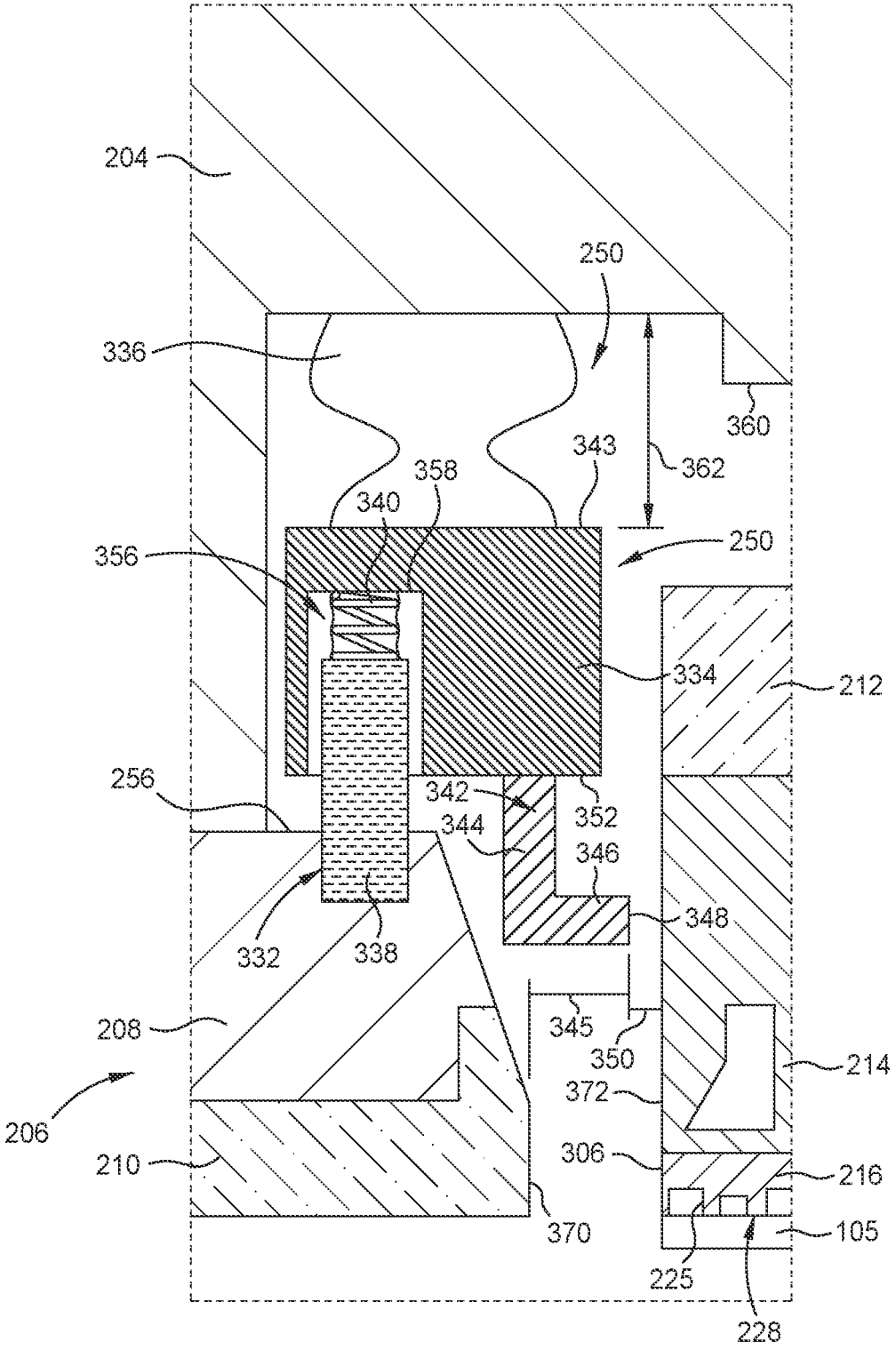
FIG. 3C is a schematic sectional view of an extension arm provided herein, according to an embodiment.

The support plate stop 250 is described in detail in FIG. 3C. The support plate stop 250 is positioned between the carrier member 204 and the backing ring 208. The support plate stop 250 is disposed radially outward from the support plate 212 and the substrate chuck element 215. The support plate stop 250 is disposed laterally between the carrier member 204 and the support plate 212. As further described with regard to FIG. 3C, the support plate stop 250 is configured to prevent the substrate from contacting the inner surface of the substrate retaining ring 210 in a similar fashion as the extension member 244 of FIG. 2A. A portion of the support plate stop 250 contacts the outer surface of one of the support plate 212 or the substrate chuck element 215 when the support plate 212 and the substrate chuck element 215 shift to an off-center position beneath the housing member 202.

FIG. 3A is a schematic sectional view of the extension member 244 provided herein, according to an embodiment. The extension member 244 is disposed radially outward from the outer surface 372 of the first membrane 214. As described above, the extension member 244 extends into the space between the support plate 212, the substrate chuck element 215 and the substrate retaining ring 210.

The second membrane element 216 includes a top surface 302, a bottom surface 308, and an outer surface 306. The top surface 302 of the second membrane element 216 is in contact with and coupled to a bottom surface of the first membrane 214. The bottom surface 308 of the second membrane element 216 includes the chucking surface 228 and the grooves 225. The outer surface 306 is the outermost surface of the second membrane element 216 and extends between the top surface 302 and the bottom surface 308. The outer surface 306 of the second membrane element 216 is disposed radially outward from the outer surface 372 of the first membrane 214. The extension member 244 is the portion of the second membrane element 216 which extends outward from the chucking surface 228 of the second membrane element 216. As described above, the outer surface 306 is disposed radially outward from the outer edge of the substrate 105.

The outer surface 306 of the second membrane element 216 extends a first distance 305 from the outer surface 372 of the first membrane 214. The first distance 305 may be about 1 mm to about 5 mm, such as about 1.5 mm to about 4 mm, such as about 2 mm to about 3 mm. The outer surface 306 of the second membrane element 216 is a second distance 307 from the inner surface 370 of the substrate retaining ring 210. The second distance 307 may be about 1 mm to about 10 mm, such as about 2 mm to about 7 mm, such as about 3 mm to about 5 mm. The difference between the outer surface 306 of the second membrane element 216 and the outer surface 372 of the first membrane 214 is caused by a difference in radius of the outer surface 306 of the second membrane element 216 and the outer surface 372 of the first membrane 214. The outer radius of the second membrane element 216 is about 0.5% to about 5% larger than the outer radius of the first membrane 214, about 0.5% to about 2% larger than the outer radius of the first membrane 214, such about 0.75% to about 1.5% larger than the outer radius of the first membrane 214.

The outer surface 306 extends further outward than the outer edge of the substrate 105. The extension member 244 is disposed radially outward from the substrate 105. The radial distance between the edge of the substrate 105 and the inner surface 370 of the substrate retaining ring 210 is a third distance 304. The third distance 304 may be about 4 mm to about 10 mm, such as 5 mm to 6 mm.

As shown in FIGS. 3A and 3B, the second membrane element 216 may be two separate portions, such as a rigid portion 321 and a soft portion 323. In some embodiments, the rigid portion 321 is stiff and has an increased hardness or modulus of elasticity compared to the soft portion 323. The rigid portion 321 may have a hardness or modulus of elasticity that is greater than or equal to the hardness or modulus of elasticity of the first membrane 214. In some embodiments, the soft portion 323 has a hardness or modulus of elasticity that is similar to the first membrane 214. In some embodiments, the rigid portion 321 may be a part of the first membrane 214. The rigid portion 321 may be a hard plastic or polyethylene. The rigid portion 321 has a hardness which can be measured on the Shore A scale using a durometer. When using the Shore A scale, the rigid portion 321 has a first hardness of greater than about 40 A, such as greater than about 50 A, such as greater than about 60 A, such as greater than about 80 A. The rigid portion 321 is disposed above the soft portion 323 and includes the extension member 244. The extension member 244 extends outward of the central body 315 of the rigid portion 321. The extension member 244 is disposed outward and around the soft portion 323. The extension member 244 has the same hardness as the rest of the rigid portion 321. In some embodiments, the rigid portion 321 may only include the extension member 244, such that the soft portion 323 is coupled to the bottom of the first membrane 214 and the extension member 244 is disposed around the circumference of the soft portion 323 to form the rigid portion 321. In some embodiments, the rigid portion 321 may be referred to as a rigid layer or a rigid membrane.

The extension member 244 is formed from the rigid portion 321 in order to better control the direction of any force vector formed due to the impact created between the extension member 244 of the second membrane element 216 and the inner surface 370 of the substrate retaining ring 210 during a polishing process. The shape of the extension member 244 is controlled so that the deformation of the extension member 244 upon contact with the inner surface 370 of the substrate retaining ring 210 is limited, and is designed so that the shape of the extension member 244 directs the force vector created by the impact consistently. In the embodiment of FIG. 3A, the shape of the outer surface 306 of the second membrane element 216 and the extension member 244 is flat and vertical, such that the outer surface 306 has a surface that forms a vertical ring disposed about the second membrane element 216. In some embodiments, the outer surface 306 may be slanted or have a curved shape relative to the vertical direction to change the force vector so that it is provided in a different direction and/or to match the shape of the inner surface 370 of the substrate retaining ring 210. The first distance 305 may also represent the distance between the outer surface of the soft portion 323 and the outer surface 320 of the rigid portion 321.

The soft portion 323 is disposed beneath the rigid portion 321 and includes the chucking surface 228 and the plurality of grooves 225. The soft portion 323 may sometimes be referred to as a chucking portion, a soft layer, or a soft membrane. The soft portion 323 is made of a soft plastic, such as a soft silicon. In some embodiments, the hardness of the soft portion 323 is measured using the Shore A scale with a durometer. When using the Shore A scale, the soft portion 323 has a second hardness of less than about 40 A, such as less than about 30 A, such as less than about 20 A, such as about 10 A to about 20 A. In some embodiments, the soft portion 323 is a 20 durometer silicone. The second hardness is less than the first hardness, such that the soft portion 323 is softer than the rigid portion 321.

In some embodiments, the soft portion 323 is disposed below the rigid portion 321, such that the top surface and the side surface of the soft portion 323 are enclosed by the rigid portion 321. The extension member 244 surrounds the outer edge of the soft portion 323. In some embodiments, the extension member 244 does not extend around the edge of the soft portion 323 and instead extends directly outward from the central body 315 of the rigid portion 321, such that the bottom surface 308 of the extension member is in line with the bottom surface of the rest of the rigid portion 321 and above the top surface of the soft portion 323. The extension member 244 extends around at least part of the soft portion 323, such that the extension member 244 may be a ring around the soft portion 323. In some embodiments, the extension member 244 is a plurality of discrete extensions disposed around the circumference of the soft portion 323.

In some embodiments, the soft portion 323 is bonded to the rigid portion 321 using an adhesive. In yet other embodiments, the soft portion 323 and the rigid portion 321 are a single piece and there is a gradual transition from the soft portion 323 to the rigid portion 321. In this embodiment, the soft portion 323 and the rigid portion 321 may be 3D printed and the density of the second membrane element 216 changes gradually from a less dense material (soft portion 323) to a more dense material (rigid portion 321). The transition may be gradual such that the hardness increases gradually between the soft portion 323 and the rigid portion 321/extension member 244.

In one embodiment, a plurality of passages 325 are disposed through the soft portion 323, the rigid portion 321, and a portion of the first membrane 214 so that each of the grooves 225 disposed through the soft portion 323 of the second membrane element 216 are fluidly connected to the channels 226 disposed through the first membrane 214. The passages 325 are shown in phantom for clarity. The passages 325 connect each groove 225 to a channel 226 in the plurality of channels 226 formed within the first membrane 214. In some embodiments, one or more of the plurality of channels 226 (e.g., substrate chucking channels) are in fluid communication with the passages 325 and the grooves 225, while another fluidly isolated and separate set of the plurality of channels 226 (e.g., load applying channels) are used to apply a pressure to the backside of the second membrane element 216 and substrate 105. The passages 325 are shown as a single passage connecting each groove 225 with a channel 226, but there may be a plurality of passages 325 connecting each groove 225 to the channel 226. In some embodiments, the passages are cylindrical in shape and multiple passages are disposed about the radius of each groove to connect different portions of each groove to the channels 226.

FIG. 3B is a schematic sectional view of an extension member 310 provided herein, according to another embodiment. The extension member 310 shown in FIG. 3B is different from the extension member 244 of FIG. 3A. The extension member 310 may replace the extension member 244, such that the extension member 310 is used in place of the extension member 244 in FIG. 2A. The extension member 310 extends from and is a part of the rigid portion 321 of the second membrane element 216. The extension member 310 is disposed between the outer surface 372 of the first membrane 214 and the substrate retaining ring 210. The extension member 310 is disposed radially outward from the outer edge of the substrate 105. The extension member 310 is configured to contact the inner surface 370 of the substrate retaining ring 210 instead of the substrate 105 contacting the inner surface 370 of the substrate retaining ring 210 when the support plate 212 and/or the substrate chucking element 215 move beneath the carrier member 204 or if the substrate 205 slides relative to the substrate chucking element 215.

The extension member 310 includes a first upper surface 318, a first lower surface 327, a first stepped surface 333, a second stepped surface 329, a second lower surface 331, a second upper surface 335, and an outer surface 320. The first upper surface 318 extends from the top of the central body 315 of the rigid portion 321. The first lower surface 327 extends from the bottom of the central body 315 of the rigid portion 321. The first upper surface 318 and the first lower surface 327 are parallel and extend outward from the second membrane element 216 towards the substrate retaining ring 210.

The first upper surface 318 intersects the first stepped surface 333, such that the first stepped surface 333 is disposed at the distal end of the first upper surface 318 furthest from the central body 315 of the rigid portion 321. The first lower surface 327 intersects the second stepped surface 329, such that the second stepped surface 329 is disposed at the distal end of the first lower surface 327 furthest from the central body 315 of the rigid portion 321. The first stepped surface 333 is disposed at an angle other than 180 degrees from the first upper surface 318, such as a 90 degree angle from the first upper surface 318. When the first stepped surface 333 is disposed at a 90 degree angle from the first upper surface 318, the first stepped surface 333 is normal to the first upper surface 318. The second stepped surface 329 is disposed at an angle other than 180 degrees from the first lower surface 327, such as a 90 degree angle from the first lower surface 327. When the second stepped surface 329 is disposed at a 90 degree angle from the first lower surface 327, the second stepped surface 329 is normal to the first lower surface 327.

Both the first stepped surface 333 and the second stepped surface 329 are parallel to one another. The first stepped surface 333 and the second stepped surface 329 are disposed so that they travel upwards from their intersections with the first upper surface 318 and the first lower surface 327 respectively, such that the first stepped surface 333 and the second stepped surface 329 are vertical surfaces and extend away from the first lower surface 327 and the substrate 105.

An upward extension 314 is formed between the first stepped surface 333 and the second stepped surface 329, such that the upward extension 314 extends vertically above the first upper surface 318 and the central body 315.

The second upper surface 335 extends from the distal end of the first stepped surface 333 furthest from the first upper surface 318. The second upper surface 335 extends outward, such that the second upper surface 335 extends away from the central body 315 of the rigid portion 321 and towards the substrate retaining ring 210. The second upper surface 335 is a horizontal surface and is parallel to the first upper surface and the first lower surface 327.

The second lower surface 331 extends from the distal end of the second stepped surface 329 furthest from the first lower surface 327. The second lower surface 331 extends outward, such that the second lower surface 331 extends away from the central body 315 of the rigid portion 321 and towards the substrate retaining ring 210. The second lower surface 331 is a horizontal surface and is parallel to at least one of the second upper surface 335, the first upper surface, and the first lower surface 327.

The outer surface 320 is disposed between the second upper surface 335 and the second lower surface 331, such that the outer surface 320 is the outermost surface of the extension member 310 in a radial direction extending from a central axis (e.g., axis A). In some embodiments, the outer surface 320 is a vertical surface and is parallel to both the first stepped surface 333 and the second stepped surface 329. In some embodiments, the outer surface 320 may have a different shape or may be slanted relative to the central axis to change the direction of the force vector when the outer surface 320 impacts the inner surface 370 of the substrate retaining ring 210.

An upper contact portion 316 is formed attached to the upward extension 314. The upper contact portion 316 is defined by at least the second upper surface 335, the second lower surface 331, and the outer surface 320. The upper contact portion 316 is disposed radially outward of the central body 315 and vertically above the central body 315. The location at which the upper contact portion 316 and the outer surface 320 of the extension member 310 contacts the substrate retaining ring 210 depends at least partially on the height 313 of the upward extension 314. The height 313 of the upward extension is defined as the distance between the first upper surface 318 and the second upper surface 335. The height 313 may be about 0 mm to about 10 mm, such as about 1 mm to about 8 mm, such as about 2 mm to about 7 mm, such as about 3 mm to about 6 mm. The height 313 of the upward extension 314 may be varied to provide a desired moment on the substrate chuck element 215 and thus the substrate 105, as described further below. As the height 313 increases, the moment acting upon the substrate 105 changes. In some embodiments it may be desirable to have either a larger or a smaller moment on different portions of the substrate 105. The moment is controlled at least partially by the height 313. The extension member 310 extends around at least part of the soft portion 323, such that the extension member 310 may be a ring around the soft portion 323. In some embodiments, the extension member 310 is a plurality of discrete extensions disposed around the circumference of the soft portion 323, such that there are multiple upper contact portions 316 and/or multiple upward extensions 314.

The distance between the outer surface 372 of the first membrane 214 and the outer surface 320 of the extension member 310 is a fourth distance 319. The fourth distance 319 may be about 2 mm to about 10 mm, such as about 3 mm to about 6 mm, such as about 4 mm to about 5 mm. The distance between the outer surface 320 of the extension member 310 and the inner surface 370 of the substrate retaining ring 210 is a fifth distance 317. The fifth distance 317 may be about 1 mm to about 5 mm, such as about 2 mm to about 4 mm, such as about 2 mm to about 3 mm. The fourth distance 319 may also represent the distance between the outer surface of the soft portion 323 and the outer surface 320 of the rigid portion 321. The difference between the outer surface 320 of the second membrane element 216 and the outer surface 372 of the first membrane 214 is caused by a difference in radius of the outer surface 306 of the second membrane element 216 and the outer surface 372 of the first membrane 214. The outer radius of the second membrane element 216 is about 0.5% to about 5% larger than the outer radius of the first membrane 214, about 0.5% to about 2% larger than the outer radius of the first membrane 214, such about 0.75% to about 1.5% larger than the outer radius of the first membrane 214.

FIG. 3C is a schematic sectional view of a support plate stop 250 provided herein, according to yet another embodiment. The support plate stop 250 of FIG. 3C is utilized in an embodiment similar to FIG. 2B. The support plate stop 250 is used in place of or simultaneously with an extension, such as one of the extension member 244 of FIG. 3A or the extension member 310 of FIG. 3B. In the embodiment of FIG. 3C, the support plate stop 250 is used in lieu of either of the extension members 244, 310. The support plate stop 250 may be a single annular support plate stop, or there may be a plurality of discrete support plate stops 250 disposed at different circumferential positions around the support plate 212 and the substrate chuck element 215. In embodiments in which there are multiple discrete support plate stops 250, each of the support plate stops 250 are only disposed about a fraction of the circumference of the support plate 212 and the substrate chuck element 215. The description of the support plate stop 250 herein may be altered to describe either of the annular support plate stop or a plurality of discrete support plate stops. The support plate 212, the first membrane 214, the second membrane element 216, and the substrate retaining ring 210 are similar to that described above, but the second membrane element 216 does not include an extension.

The support plate stop 250 is disposed between the backing ring 208 and the carrier member 204. In some embodiments, portions of the support plate stop 250 are coupled to the top surface 256 of the backing ring 208 and the bottom surface 360 of the carrier member 204. The support plate stop 250 includes a body 334, a guide pin 338, an extension arm 342, and a bladder 336. The body 334 is the main body of the support plate stop 250 and is connected to the backing ring 208 by the guide pin 338 and connected to the carrier member 204 by the bladder 336.

The guide pin 338 is disposed within a cavity 332 disposed within the top surface 256 of the backing ring 208. The cavity 332 may be a cylindrical cavity. The inside surface of the cavity 332 may be approximately the same size as the outside surface of the guide pin 338. The guide pin 338 is coupled to the cavity 332 of the backing ring 208 using one or more fasteners, or an adhesive. The opposite end of the guide pin 338 furthest from the cavity 332 is disposed within an opening 356 through a portion of the body 334. The opening 356 is a cylindrical opening formed through the bottom surface 352 of the body 334. The opening 356 has an open end disposed through the bottom surface 352 and stops at a wall 358. The wall 358 is disposed at the back end of the opening 356. A spring 340 is disposed between an upper end of the guide pin 338 and a surface of the opening 356. The spring 340 is disposed against the wall 358 of the opening 356 and the end of the guide pin 338. The spring 340 is a compressible spring and is configured to provide an upward force on the body 334 from the guide pin 338. The spring 340 supports the weight of the body 334 while allowing the body 334 to move upwards and downwards within a specified range. The guide pin 338 is configured to enable movement of the body 334 along a length of the opening 356, such as in an upwards and/or a downwards motion.

The bladder 336 is disposed between the body 334 and the bottom surface 360 of the carrier member 204. The bladder 336 is made from a flexible material, such that the bladder 336 can change shape without stretching. The bladder 336 is fluidly connected to a gas or fluid source such that the bladder 336 can have varying quantities of fluid disposed therein. The variable quantity of fluid within the bladder 336 changes the pressure within the bladder 336, which in turn will allow the shape of the bladder 336 to change. The pressure within the bladder 336 can actuate the body 334 by pushing the body 334 downward or pulling the body 334 upwards with respect to the bottom surface 360 of the carrier member 204 by adjusting the pressure within an internal region of the bladder 336. The spring 340 and pneumatically controlled bladder 336 are used in combination to control the vertical position of the body 334. The direction in which the bladder 336 is configured to actuate the body 334 is the same direction along which the guide pin 338 enables movement of the body 334.

The extension arm 342 is attached to the body 334 and extends from the body 334 downward towards the polishing pad 108 (FIG. 1). In some embodiments, the extension arm 342 is a part of the body 334. The extension arm 342 may have an L-shape. The extension arm 342 has a first member 344 and a second member 346. In some embodiments, the extension arm 342 is solid ring that includes the first member 344 and the second member 346. In other embodiments, the extension arm 342 includes a plurality of discrete elements that are disposed in an equally spaced array that extends in a circular direction about the central axis of the body 334. In one example, the six or more discrete extension arms 342 are positioned in the array that extends about the central axis of the body 334. The first member 344 is a vertical member extending from the bottom surface 352 of the body 334. The first member 344 connects to the second member 346, such that the second member 346 is disposed at a right angle from the first member 344. The second member 346 is disposed at the distal end of the first member 344 furthest from the body 334. The second member 346 extends inward from the body 334 and towards the support plate 212, the first membrane 214, and the second membrane element 216. A contact surface 348 is disposed on the innermost end of the second member 346. The contact surface 348 is a surface parallel to the outer surface 372 of the first membrane 214. The second member 346 does not extend all the way to contact the first membrane 214 or the second membrane element 216.

A gap is disposed between the contact surface 348 of the second member 346 and the outer surface 372 of the first membrane 214. The gap between the contact surface 348 of the second member 346 and the outer surface 372 of the first membrane 214 when the substrate chuck element 215 is centered beneath the carrier member 204 is a first gap distance 350. The first gap distance 350 may be less than about 5 mm, such as less than about 4 mm, such as less than about 3 mm, such as less than about 2 mm. In some embodiments, the first gap distance 350 is about 1 mm to about 5 mm, such as about 2 mm to about 4 mm, such as about 2 mm to about 3 mm. As the substrate chuck element 215 is configured to shift slightly underneath the carrier member 204 during substrate processing, the gap between the first or second membranes 214, 216 (first membrane in FIG. 3C) and the contact surface 348 of the second member 346 may be brought to a distance of about zero, such that the contact surface 348 contacts the first or second membranes 214, 216.

At least a portion of the second member 346 is disposed in the area between the inner surface 370 of the substrate retaining ring 210 and the outer surface 372 of the first membrane 214. The contact surface 348 is disposed radially between the substrate retaining ring 210 and the outer surface 372. The contact surface 348 is disposed a radial distance 345 from the inner surface 370 of the substrate retaining ring 210. The radial distance 345 may be about 1 mm to about 7 mm, such as about 2 mm to about 6 mm, such as about 3 mm to about 5 mm.

The bladder separates the body 334 and the carrier member 204. In some embodiments, the height 362 between the top surface 343 of the body 334 and the bottom surface 360 of the carrier member 204 is varied over a range. The range in which the height 362 varies may be about 1 mm to about 15 mm, such as about 3 mm to about 12 mm, such as about 5 mm to about 10 mm. By changing the height 362 between the top surface 343 of the body 334 and the bottom surface 360 of the carrier member 204, the location of contact between the contact surface 348 and the first or second membranes 214, 216 is able to be changed either during a polishing operation or in between polishing operations. The change in location of contact allows for the forces and moment exerted on the substrate to be controlled. The forces and moment may be moved or the magnitude may be change to improve polishing operations.

Figure 4B:
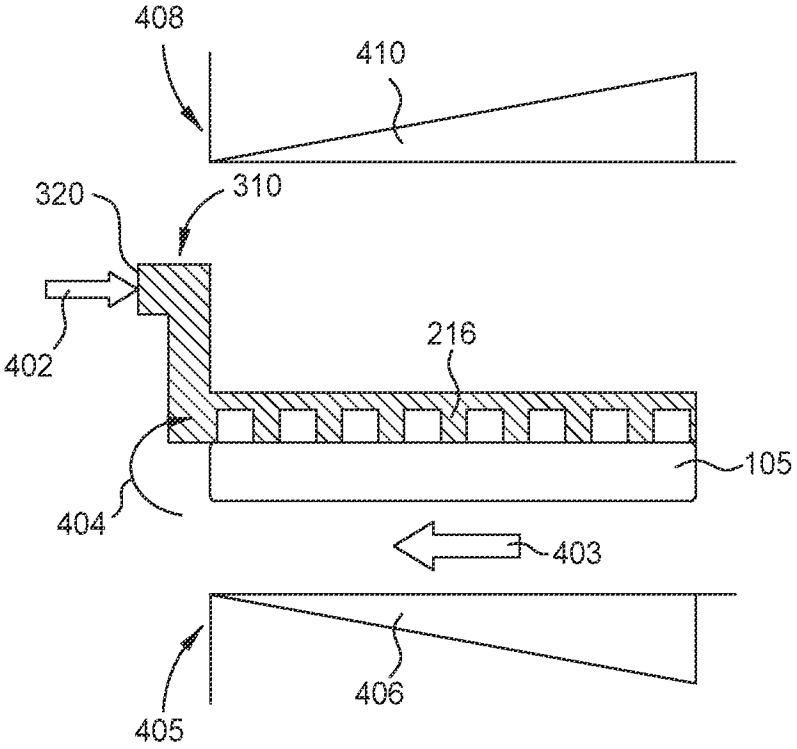
FIGS. 4A-4B are schematic force diagrams of the extension members of FIGS. 3A-3B.
Figure 4A:
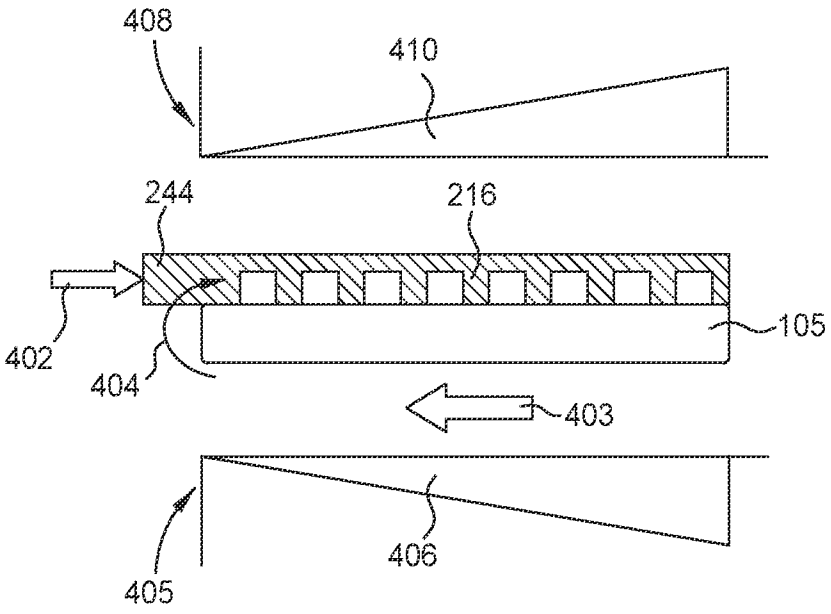

FIGS. 4A-4B are schematic force diagrams of the extension members, such as the extension member 244 and the extension member 310, of FIGS. 3A-3B. In FIGS. 4A-4B the second membrane element 216 is shown with a substrate 105 coupled to the bottom surface. The substrate 105 is coupled using a chucking action as described herein. During substrate polishing, the polishing pad 108 (FIG. 1) slides across the lower surface of the substrate 105 and creates a friction force 403 on the substrate 105. The friction force 403 pushes the substrate 105 sideways (e.g., horizontal direction). The substrate 105 is coupled to the second membrane element 216, such that the first membrane 214 and the support plate 212 are also coupled to the substrate 105 through the second membrane element 216. Therefore, when the substrate 105 moves sideways due to the friction force 403, each of the second membrane element 216, the first membrane 214, and the support plate 212 move with the substrate 105.

During processing, a portion of the extension member 244 of FIGS. 3A and 4A, or the extension member 310 of FIGS. 3B and 4B, will come in contact with the inner surface 370 of the substrate retaining ring 210 (FIGS. 3A and 3B). By having an extension member 244 or an extension member 310 contact the inner surface 370 of the substrate retaining ring 210, the edge of the substrate 105 is kept from contacting the inner surface 370 of the substrate retaining ring 210. Keeping the substrate 105 from contacting the substrate retaining ring 210 keeps the edge of the substrate 105 from being damaged by the substrate retaining ring 210. The extension members 244, 310 made from a rigid material as described above. The rigid material prevents the extension member 244 or the extension member 310 from deforming when they come into contact with the substrate retaining ring 210. Preventing deformation provides a repeatable and controlled contact point between the extension member 244 or the extension member 310 and the substrate retaining ring 210. When the substrate retaining ring 210 comes into contact with either of the extension members 244, 310, the substrate retaining ring 210 enacts a reaction force 402 on the second membrane element 216 through the extension member 244 or the extension member 310. The friction force 403 and the reaction force 402 create a moment 404. The moment 404 acts about the edge of the substrate 105 and may cause the edge of the substrate nearest the contact point to lift slightly.

The moment 404, shown in FIGS. 4A-4B, accounts for the reaction force 402, but does not include other forces created on the surface of the substrate 105, such as normal forces caused by the second membrane 216 and the support plate 212 or the forces generated due to the interaction of the substrate and the polishing pad. The normal force(s) caused by the moment 404 and exerted by the polishing pad 108 (FIG. 1) onto the substrate 105 are shown in the first graph 405. The first graph 405 shows a first force gradient 406 across the length of the substrate 105 being exerted from the reaction force applied by the polishing pad 108 onto the substrate 105. The first force gradient 406 is caused by the extension member's 244, 310 contact with the substrate retaining ring 210 and the moment 404 exerted from the reaction force applied by the polishing pad 108 onto the substrate 105. The magnitude of the first force gradient 406 is therefore greatest near the edge of the substrate furthest from the contact point between the extension member 244 or extension member 310 and the substrate retaining ring 210. The force exerted by the substrate 105 onto the polishing pad 108 is shown in the second graph 408. The second graph 408 shows a second force gradient 410 across the length of the substrate 105, which is in contact with the polishing pad 108. The magnitude of the normal force exerted by the substrate 105 onto the polishing pad 108 is greatest near the edge of the substrate 105 contacting the polishing pad 108 which is furthest from the contact point between the extension member 244 or extension member 310 and the substrate retaining ring 210. The magnitude of the first force gradient 406 and the second force gradient 410 are greater in embodiments similar to the embodiment of FIG. 4B, as compared to the embodiment illustrated in FIG. 4A, as the upward extension 314 provides a longer moment arm and increased the magnitude of the moment 404.

The second force gradient 410 may be combined with other force gradients, such as the pressure applied by the second membrane 216 on the substrate 105. One will note that the creation of the moment 404, and thus the second force gradient 410, is useful to correct the high contact forces generated at the edge of a substrate 105 during polishing due to the interaction of the edge of the substrate 105 and the polishing pad 108. By way of example, the cause of the non-uniform high contact force at the edges of a substrate 105 during a polishing process that utilizes a polishing pad 108 is further described in relation to FIGS. 7A-7C in U.S. Pat. No. 5,795,215 to Guthrie et al. (filed Jun. 19, 1996). Therefore, one skilled in the art will appreciate that the creation of the second force gradient 410 can be used to counteract the non-uniform contact forces generated near the edge of the substrate due at least to the pressure applied to the substrate 105 by the second membrane 216 through the support plate 212.

The embodiment of FIG. 3C is configured to generate similar friction forces, reaction forces, and moments acting therein. The reaction force for the embodiment of FIG. 3C is similar to that shown in FIG. 4B, but the extension is replaced with the extension arm 342 and the reaction force may act in a slightly different location along the outer surface 372 of the first membrane 214.

The apparatus disclosed herein enable a controlled contact point between a substrate retaining ring and a substrate chuck membrane without the substrate itself contacting the substrate retaining ring. The apparatus may be any one of a contact extension disposed outward from the substrate chuck membrane or a support plate stop coupled to a carrier member and extending inwards to contact the substrate chuck membrane. The controlled contact point provides improved tuning/predictability of the forces exerted on the substrate during substrate polishing.

As used herein, the term "about" defines an approximated value. The value modified with the term "about" may be plus or minus about 0.5% of the value following the term "about." Each measurement or range in which "about" is utilized may also be defined without the term "about."

While the foregoing is directed to embodiments of the present disclosure, other and further embodiments of the disclosure may be devised without departing from the basic scope thereof, and the scope thereof is determined by the claims that follow.

What is claimed is:

1. An apparatus for substrate polishing comprising:
- a housing member;
- a carrier member coupled to the housing member, the carrier member forming at least a portion of a carrier volume;
- a support plate disposed radially inside of the carrier volume and coupled to the carrier member; and
- a substrate chuck element coupled to the support plate and comprising:
  - a first membrane comprising a plurality of channel regions; and
  - a second membrane coupled to a bottom surface of the first membrane, the second membrane further comprising a rigid portion and a soft portion, the rigid portion disposed between the soft portion and first membrane, the rigid portion comprising an extension member disposed radially outward of the soft portion, wherein the rigid portion has a first hardness and the soft portion has a second hardness less than the first hardness.

2. The apparatus of claim 1, wherein the housing member, the carrier member, the support plate, the first membrane, and the second membrane share a common central axis.

3. The apparatus of claim 1, wherein a top surface of the second membrane is bonded to the bottom surface of the first membrane.

4. The apparatus of claim 1, wherein there are 5 to 15 channels disposed through the first membrane and the second membrane.

5. The apparatus of claim 1, wherein the rigid portion has an outer radius of about 151 mm to about 155 mm.

6. The apparatus of claim 1, wherein the rigid portion further comprises a central body disposed over the soft portion and the extension member extends outward of the central body.

7. The apparatus of claim 6, wherein the rigid portion has a hardness of greater than about 40 A on the Shore A scale.

8. The apparatus of claim 1, wherein a plurality of passages extend from the plurality of channel regions through the second membrane.

9. An apparatus for substrate polishing comprising:
- a substrate support carrier configured to be disposed over a polishing pad and comprising:
  - a housing member;
  - a carrier member coupled to the housing member and forming a portion of a carrier volume inside of the carrier member;
  - a support plate disposed inside of the carrier member and the carrier volume; and
  - a substrate chuck element comprising:
    - a first membrane comprising a plurality of channel regions; and
    - a second membrane coupled to a bottom surface of the first membrane, the second membrane comprising a rigid portion and a soft portion, the rigid portion disposed between the soft portion and first membrane, the rigid portion comprising an extension member disposed radially outward of the soft portion, wherein the rigid portion has a first hardness and the soft portion has a second hardness less than the first hardness, a portion of the rigid portion surrounding a part of the soft portion and extending radially outward of the soft portion of the second membrane and the first membrane, wherein the rigid portion includes an outer surface configured to contact an inner surface of a retaining ring when the substrate chuck element moves within the carrier volume.

10. The apparatus of claim 9, wherein the rigid portion further comprises a central body disposed over the soft portion and the rigid portion extends outward of the central body.

11. The apparatus of claim 10, wherein the rigid portion has a hardness of greater than about 40A on the Shore A scale and the soft portion has a hardness of less than about 30A on the Shore A scale.

12. The apparatus of claim 9, wherein the rigid portion further comprises:

a central body;

an upward extension extending above the central body; and an upper contact portion attached to an upper distal end of the upward extension and disposed away from the central body.

13. The apparatus of claim 9, further comprising a retaining ring coupled to the carrier member and further forming the carrier volume, wherein the rigid portion is disposed radially inward of the retaining ring.

14. The apparatus of claim 13, wherein an outer surface of the rigid portion is parallel to an inner surface of the retaining ring.

15. The apparatus of claim 9, further comprising a gradual transition in hardness from the soft portion to the rigid portion.

16. The apparatus of claim 9, wherein a plurality of passages extend from the plurality of channel regions through the second membrane.

* * * * *